United States Patent [19]

Edwards

[11] 4,151,894

[45] May 1, 1979

[54] INSULATING COVER FOR PULL DOWN STAIR

[76] Inventor: Robert A. Edwards, 115 Lundie La., Petersburg, Va. 23803

[21] Appl. No.: 842,903

[22] Filed: Oct. 17, 1977

[51] Int. Cl.[2] ..... E06B 5/00; E06B 3/00; E04F 11/04

[52] U.S. Cl. ..... 182/77; 49/463; 52/200

[58] Field of Search ..... 182/77–81, 182/46, 47; 52/200; 49/33, 463, 254

[56] References Cited

U.S. PATENT DOCUMENTS

| | | | |
|---|---|---|---|
| 2,848,722 | 8/1958 | Choporis | 49/33 |
| 3,350,823 | 11/1967 | Murray | 52/200 |
| 3,807,528 | 4/1974 | Frank | 182/181 |
| 3,841,437 | 10/1974 | Caughey | 182/106 |

FOREIGN PATENT DOCUMENTS

| | | | |
|---|---|---|---|
| 204152 | 7/1959 | Austria | 182/47 |
| 894286 | 4/1962 | United Kingdom | 49/463 |

*Primary Examiner*—Reinaldo P. Machado
*Attorney, Agent, or Firm*—Howard I. Podell

[57] ABSTRACT

An insulating cover larger than and fitting over the opening in an upper floor between the upper floor and an adjacent lower floor of a structure which has an open top, box-like shape with a pair of wheels on its back wall and front inside and outside handles. Optionally, the edges of the wall have an insulating gasket and the top of the cover has insulating means thereon. The cover is sufficiently deep to receive the folded stairs between its top and the trap door.

5 Claims, 4 Drawing Figures

INSULATING COVER FOR PULL DOWN STAIR

FIELD OF THE INVENTION

This invention relates generally to an insulating cover for retractable or folding stairs.

STATEMENT OF PRIOR ART:

The prior art, as exemplified by U.S. Pat. Nos. 1,621,539; 3,331,466; 3,024,863; and 2,572,281 is generally illustrative of various devices of this type. While such devices are generally acceptable for their intended purpose they have not proven to be entirely satisfactory in that they are either complex and expensive to manufacture, or bulky and inconvenient to use or to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in an insulating cover larger than and fitting over the opening in an upper floor between the upper floor and an adjacent lower floor of a structure which has an open top, box-like shape with a pair of wheels on its back wall and front inside and outside handles. Optionally, the edges of the wall have an insulating gasket and the top of the cover has insulating means thereon. The cover is sufficiently deep to receive the folded stairs between its top and the trap door.

BRIEF DESCRIPTION OF THE DRAWING

In the accompanying drawing, in which are shown two of the various possible illustrative embodiments of this invention, wherein like reference character identify the same or like parts.

DESCRIPTION OF THE PREFERRED EMBODIMENT

Figure 1:
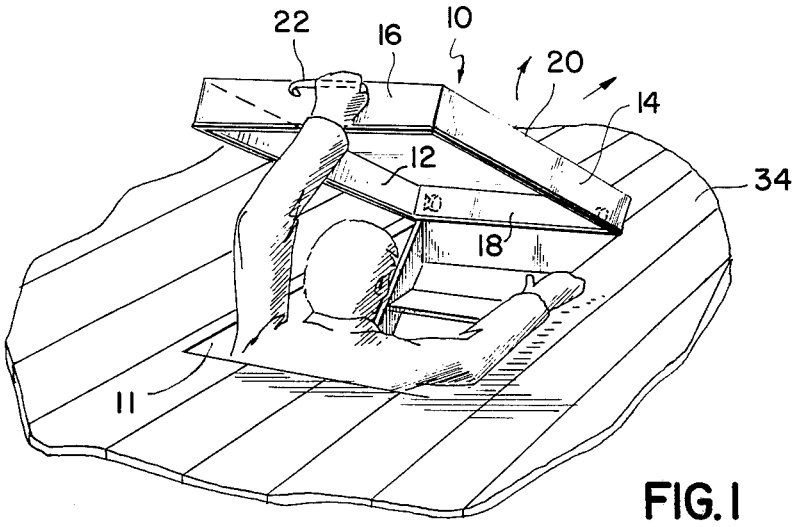
FIG. 1 is a view in perspective of a preferred form of the invention installed in the opening in the ceiling of a room.
Figure 2:
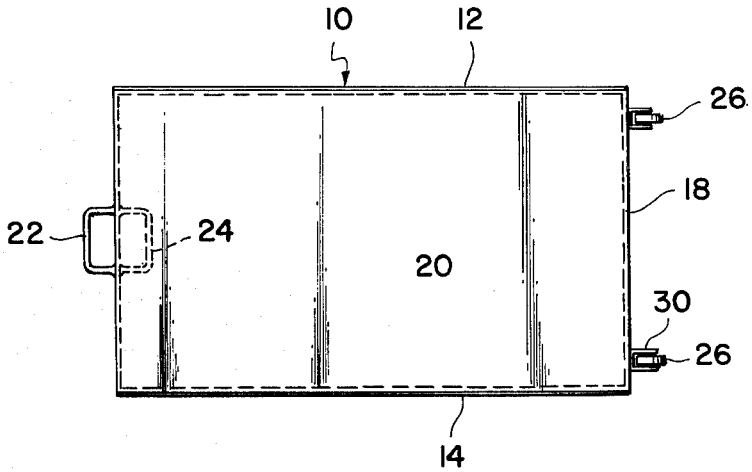
FIG. 2 is a top plan view, partly in section, of the cover according to a preferred embodiment.

With reference to the drawing, there is shown and illustrated an insulating cover for a folding stair constructed in accordance with the principles of the invention and designated generally by reference character 10. The particular device represented includes an inverted box-like structure comprising side walls 12 and 14 joined to front wall 16, rear wall 18 and to a top 20.

Preferably these elements will be made of wood, fiberglass, or other suitable plastic.

Secured to front wall 16 are an outer handle 22 and an inner handle 24. Secured to the rear wall 18 near its lower edge are spaced wheels 26 journalled on an axle 29 supported by brackets 30. In order to fit on most stairway openings, the side walls should be about 60 inches long and from 6 to 12 inches high while the end walls are of the same height but 36 inches long. The folding steps 32 of the stairs or folding ladder are received in the cover 10 between it and the usual trap door. Cover 10 is larger than opening 11 in the ceiling.

To operate, the trap door is pulled down; the steps are unfolded and ascended half-way to reach inside handle 24 to lift the cover 10 one to three inches so as to bring wheels 30 in contact with attic floor 34.

Figure 4:
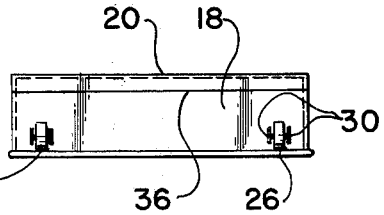
FIG. 4 is a rear view of another embodiment.

Optionally, top 20 may be double-walled with a second wall 36, as shown in FIG. 4. This provides an insulating air space between top 20 and second wall 36.

Figure 3:
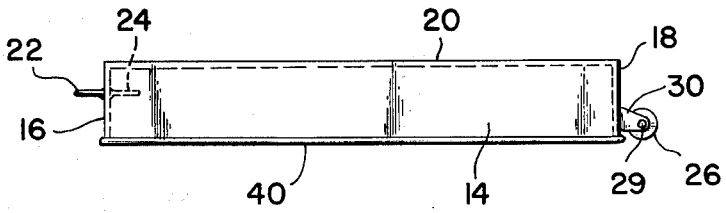
FIG. 3 is a side elevation thereof.

Similarly, the inner surface of top 20 may have a foamed layer of an insulator. Also, a rubber gasket 40 (FIG. 3) may be fixed on the lower edges of the cover so as to sealingly engage attic floor 34.

With the cover of the invention most of the heat lost through a trap door is saved. The cover can be retrofitted onto existing attics, as well as installed in new buildings.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. An insulating cover adapted to fit over an opening between the upper floor and the lower floor of a structure in which a folding stairway selectively provides access between the floors and wherein the bottom of said opening is closed by a trap door, when the folding stairway is in the folded position; said cover comprising an inverted box-like structure of a size such as to over lie said opening and having a top, front, rear and side walls; inner and outer handles fixed to said front wall; a pair of wheels on the outside of said rear wall and adapted to contact the surface of said upper floor when said cover is raised; said cover having a depth sufficient to receive therein said stairway in the folded position of the stairway between said top and said trap door.

2. The invention as recited in claim 1, wherein said top is double-walled.

3. The invention as recited in claim 1, wherein the inner surface of said top and walls has a layer of insulation.

4. The invention as recited in claim 1, wherein said walls have sealing means on their lower edges.

5. The cover of claim 1 mounted over the said opening and housing the stairway in the folded position of the stairway.

* * * * *